US005899264A

United States Patent [19]

Marschke

[11] Patent Number: 5,899,264

[45] Date of Patent: May 4, 1999

[54] STEAM SUPPLY AND CONDENSATE REMOVAL APPARATUS FOR HEATED ROLL

[75] Inventor: Carl R. Marschke, Phillips, Wis.

[73] Assignee: Marquip, Inc., Phillips, Wis.

[21] Appl. No.: 08/932,332

[22] Filed: Sep. 17, 1997

[51] Int. Cl.[6] ..... F28D 11/02

[52] U.S. Cl. ..... 165/89; 34/119; 34/115; 492/46

[58] Field of Search ..... 34/115, 119, 124, 34/125; 492/46; 165/89, 90

[56] References Cited

U.S. PATENT DOCUMENTS

| | | | |
|---|---|---|---|
| 2,170,405 | 8/1939 | Greenwood | 165/90 |
| 2,341,335 | 2/1944 | Simmons | 156/359 |
| 3,228,462 | 1/1966 | Smith, Jr. | 165/89 |
| 3,914,875 | 10/1975 | Schiel | 34/454 |
| 4,086,691 | 5/1978 | Smith, Jr. | 29/890.36 |
| 4,542,593 | 9/1985 | Viitanen et al. | 34/454 |
| 4,644,668 | 2/1987 | Hull | 34/119 |
| 4,773,468 | 9/1988 | Lauener | 164/429 |
| 4,781,795 | 11/1988 | Miller | 162/359 |
| 4,965,920 | 10/1990 | Smith | 19/258 |
| 5,072,497 | 12/1991 | Zaoralek | 29/123 |
| 5,111,876 | 5/1992 | Nash | 165/151 |
| 5,230,169 | 7/1993 | Jaatinen et al. | 34/124 |
| 5,271,456 | 12/1993 | Baumann | 165/90 |
| 5,456,309 | 10/1995 | Vannuci, Jr. | 165/1 |
| 5,533,569 | 7/1996 | Reibel etal. | 165/90 |
| 5,655,596 | 8/1997 | Zaoralek | 165/90 |

*Primary Examiner*—Henry A. Bennett
*Assistant Examiner*—Pamela A. Wilson
*Attorney, Agent, or Firm*—Andrus, Sceales, Starks & Sawall

[57] ABSTRACT

A steam heated web processing roll includes a fully enclosed steam and condensate flow-through system which maintains the roll end walls at approximately the same operating temperature as the functional cylindrical outer roll shell at normal rotational speeds. The closed loop system also assists in purging non-condensible gases from the steam path. At low roll speeds or when the roll is stopped, a valving system closes all of the condensate return paths except one or more of the lowermost paths from which condensate pooling in a sump at the bottom of the roll is withdrawn. This prevents undesirable cooling of the lower portion of the roll as compared to the remaining portion, thereby reducing the possibility of bowing of the roll by thermal distortion.

15 Claims, 6 Drawing Sheets

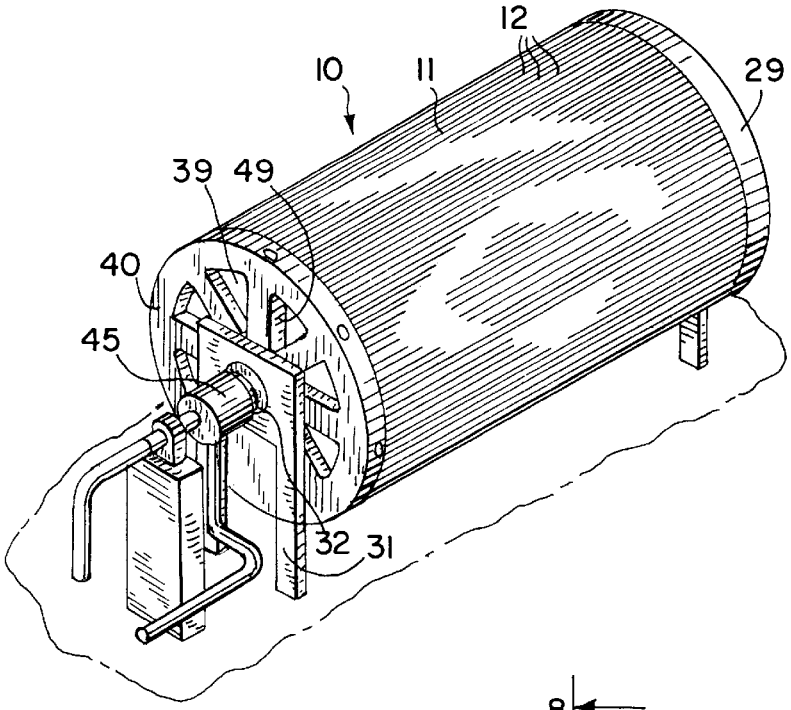
FIG. 1
FIG. 7
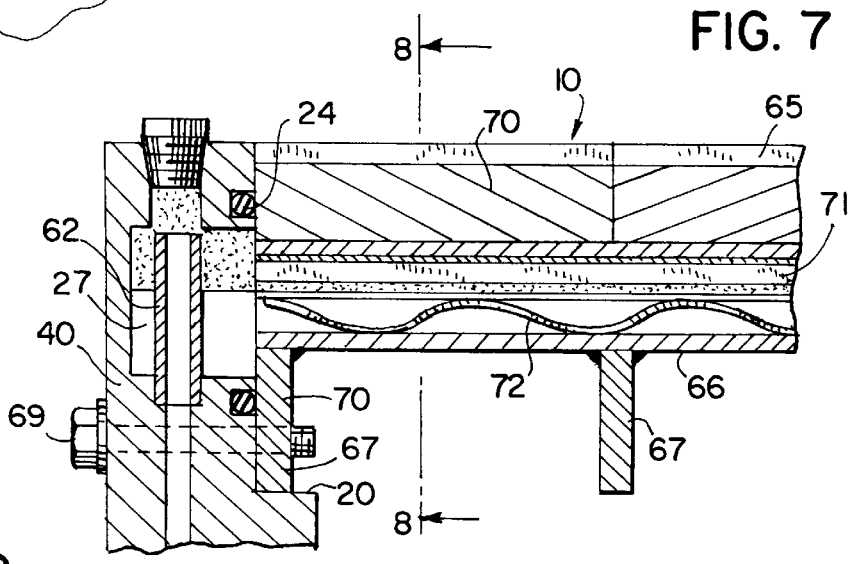
FIG. 8
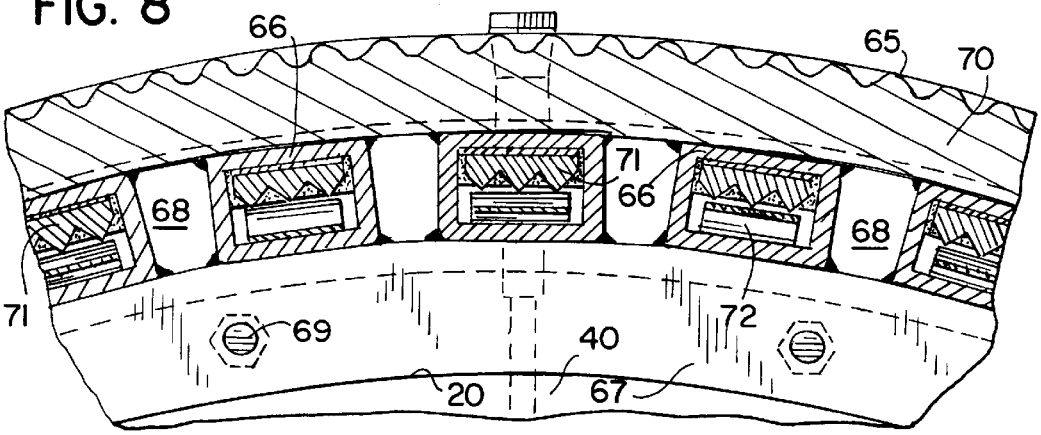

FIG. 10
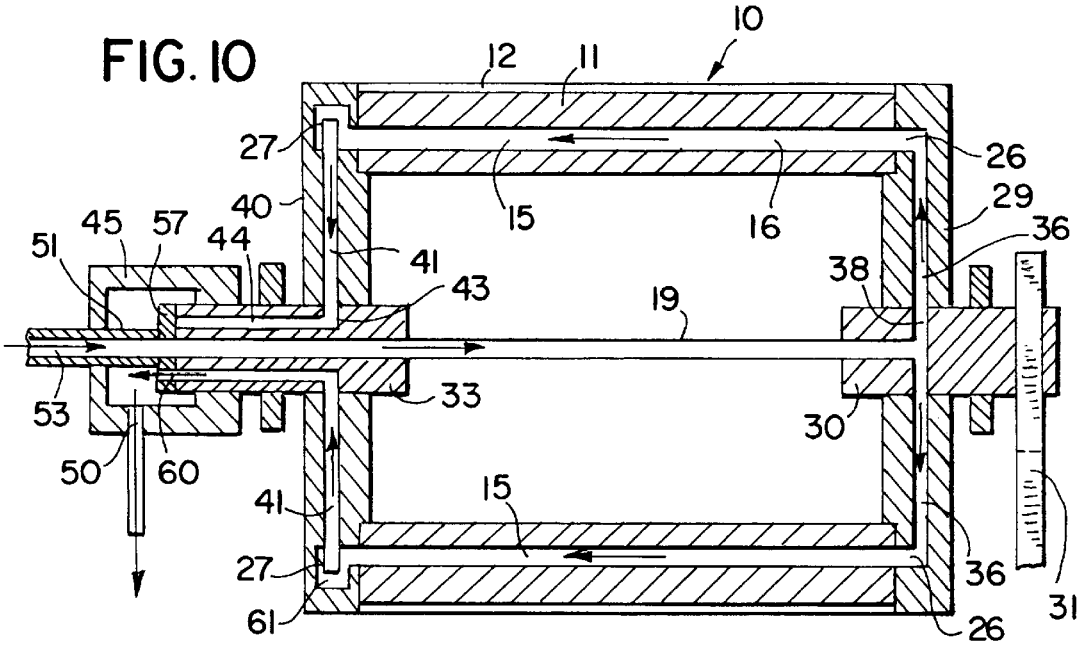
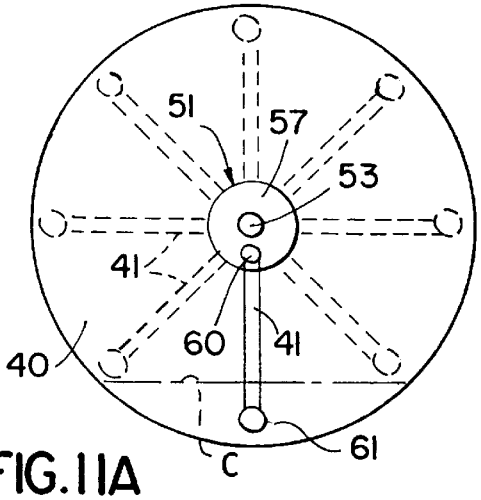
FIG. 11A
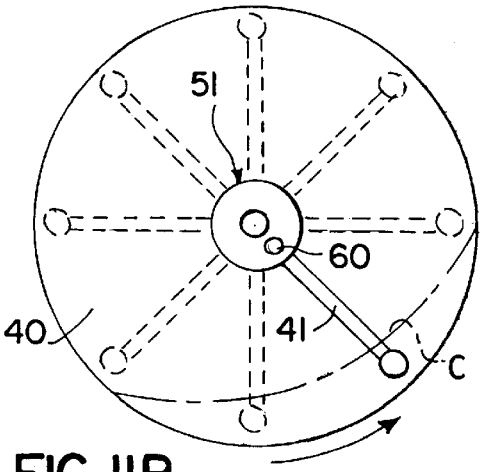
FIG. 11B
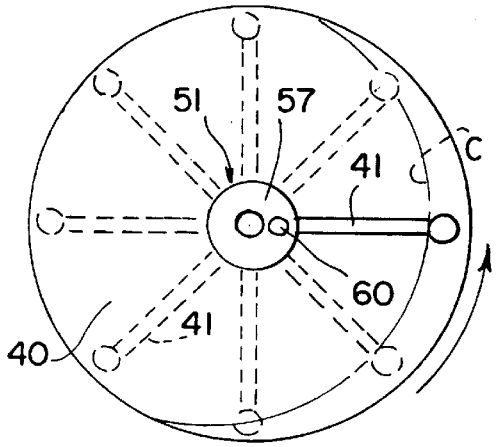
FIG. 11C
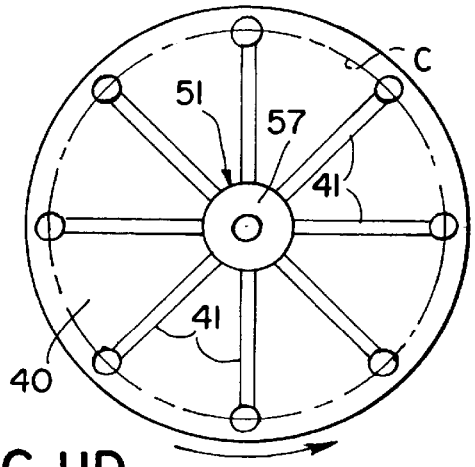
FIG. 11D

STEAM SUPPLY AND CONDENSATE REMOVAL APPARATUS FOR HEATED ROLL

BACKGROUND OF THE INVENTION

The present invention pertains to an apparatus for heating a rotary cylindrical roll and, more particularly, to an apparatus for heating a roll with steam and for handling the removal of condensate from a steam heated roll.

Rotary cylindrical drums and rolls are used in a wide variety of material treating applications. In one particularly common use, webs of material to be treated are wrapped around a heated rotary roll which transmits heat to the web traveling thereon. Steam is the most commonly used heating fluid and steam heated rolls are well known in the art. Steam is typically supplied and condensate water removed from the interior of the roll via axial bores in the roll shaft and utilizing rotary joints for the steam supply and siphon tubes for condensate withdrawal. The steam may be supplied to the entire open interior of the roll or may be directed to channels formed in the interior cylindrical wall of the roll. Condensate removal may be effected with a non-rotating siphon tube with an inlet positioned near the interior of the roll shell at the lowermost point of roll rotation, or with radially extending condensate removal tubes which extend from the roll shell to a common condensate outlet in the roll shaft.

At least two problems which are directly related to uneven roll heating and resultant thermal distortion have long plagued the industry. Condensate in the roll interior will accumulate by gravity flow in the lowermost region of the roll, except when the roll is turning at a high enough speed so that centrifugal force overcomes the force of gravity and the condensate is spread in a thin layer on the entire cylindrical interior of the drum, a condition sometimes referred to as "rimming". However, at low speed or when the roll is stopped, the condensate may pool to a depth sufficient to insulate the metal roll shell from direct contact by steam and, as a result, the lower portion of the roll shell will be much cooler than the remainder of the roll shell. The cooler portion of the roll shell will tend to bow inwardly with potentially serious consequences. For example, in a steam heated corrugating roll of the type used in the manufacture of single face corrugated paperboard, the bowing resulting from thermal distortion may cause the paper web to be cut by greatly varying nip forces when roll rotation is commenced.

In steam heated rolls, if the roll end walls (or end bells) are not maintained close to the operating temperature of the heated cylindrical drum wall, thermal distortion may result in roll shell separation from the end walls.

Another problem in steam heating systems for rolls is the inevitable presence of non-condensible gases in the steam system occurring, for example, from unavoidable air leakage and the like. If such non-condensible gases are not flushed from the system, they will diminish the rate of condensate formation and, therefore, the heat transfer capability of the steam. A flow-through system for supplying steam and utilizing steam pressure to return the condensate would allow the non-condensible gases to be flushed for removal outside the roll utilizing removal means, such as a flash tank, well known in the art.

In accordance with the present invention, a steam heated roll utilizes a flow-through steam supply and condensate return system which addresses and solves all of the problems attendant prior art rolls.

SUMMARY OF THE INVENTION

The present invention is applicable to a steam heated roll of the type rotatable on a generally horizontal axis and including a cylindrical outer wall, a pair of enclosing end walls, a series of generally parallel and axially extending open-ended steam tubes which are mounted in heat conducting contact with the cylindrical outer wall, an annular steam header which interconnects the open ends of the steam tubes on one end of the roll, and an annular condensate header which interconnects the open ends of the steam tubes on the other end of the roll. The improved apparatus of the present invention comprises a steam inlet in one end wall, a plurality of radially extending stream transfer passages which are spaced circumferentially around the roll axis adjacent one end wall to provide steam transfer paths between the steam inlet and the steam header, a condensate outlet in one end wall, a plurality of radially extending condensate transfer passages which are spaced circumferentially around the roll axis adjacent the other end wall to provide condensate transfer paths between the condensate header and the condensate outlet, and valve means in the condensate outlet for blocking the flow of condensate through selected condensate transfer passages in a first valve position and for permitting the flow of condensate through all of the condensate transfer passages in a second valve position.

In the preferred embodiment, the steam transfer passages and the condensate transfer passages comprise radial bores in their respective end walls. The annular headers are also preferably formed in the radial outer edges of the respective end walls. The condensate header includes an integral annular surface which forms the radially outermost surface of the sump and defines a lowermost condensate collection point for at least one condensate transfer passage in the first valve position.

The preferred embodiment of the present invention includes roll stub shafts or shaft ends attached to the end walls to mount the roll for rotation. The steam inlet and condensate outlet are each formed in a shaft end. Preferably, the steam inlet and condensate outlet are formed in the same shaft end. A steam delivery conduit extends axially through the roll interior between the shaft ends. The condensate outlet comprises a plurality of circumferentially spaced, axially extending blind bores in the shaft end, each of which blind bores provides open communication with a radial condensate transfer passage. The steam inlet comprises an axial bore in the shaft which is concentric with the plurality of blind bores. In the preferred embodiment, the valve means comprises a steam inlet sleeve which is slidable axially in the axial shaft bore and provides a steam path in both the first and second valve positions.

BRIEF DESCRIPTION OF THE DRAWINGS

FIG. 1 is a perspective view of a heated roll of the type embodying the steam supply and condensate removal apparatus of the subject invention.

FIG. 7 is a partial vertical section through one end of a heated roll of an alternate construction.

FIG. 8 is a vertical section taken line 8—8 of FIG. 7.

FIG. 10 is a schematic vertical section through the roll showing the overall steam and condensate flow paths.

FIGS. 11A–D show schematic representations of condensate positions in the roll in relation to rotational speed.

DETAILED DESCRIPTION OF THE PREFERRED EMBODIMENTS

Figure 2:
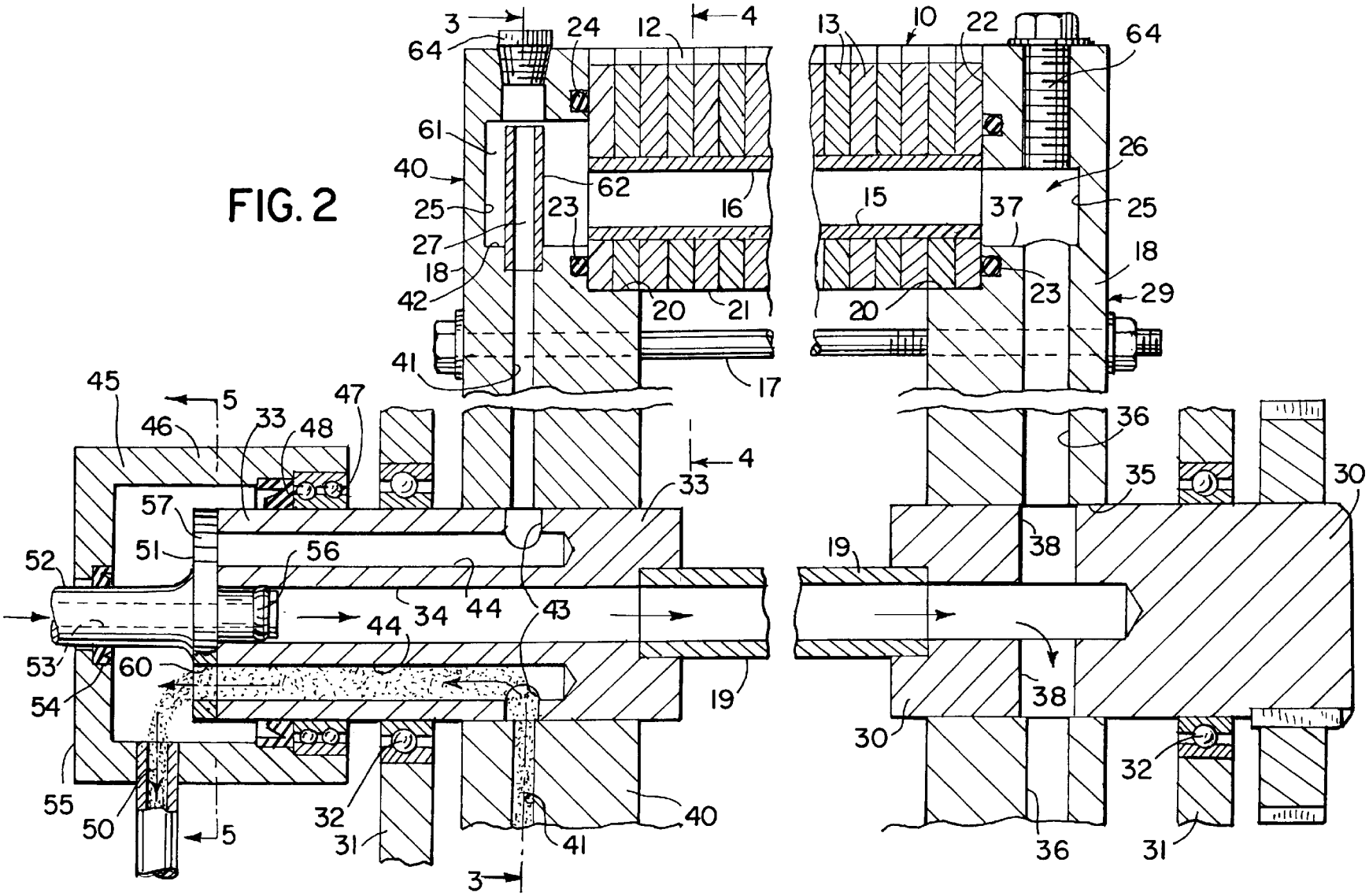
FIG. 2 is a partial vertical section through the upper portion of the heated roll of FIG. 1.
Figure 3:
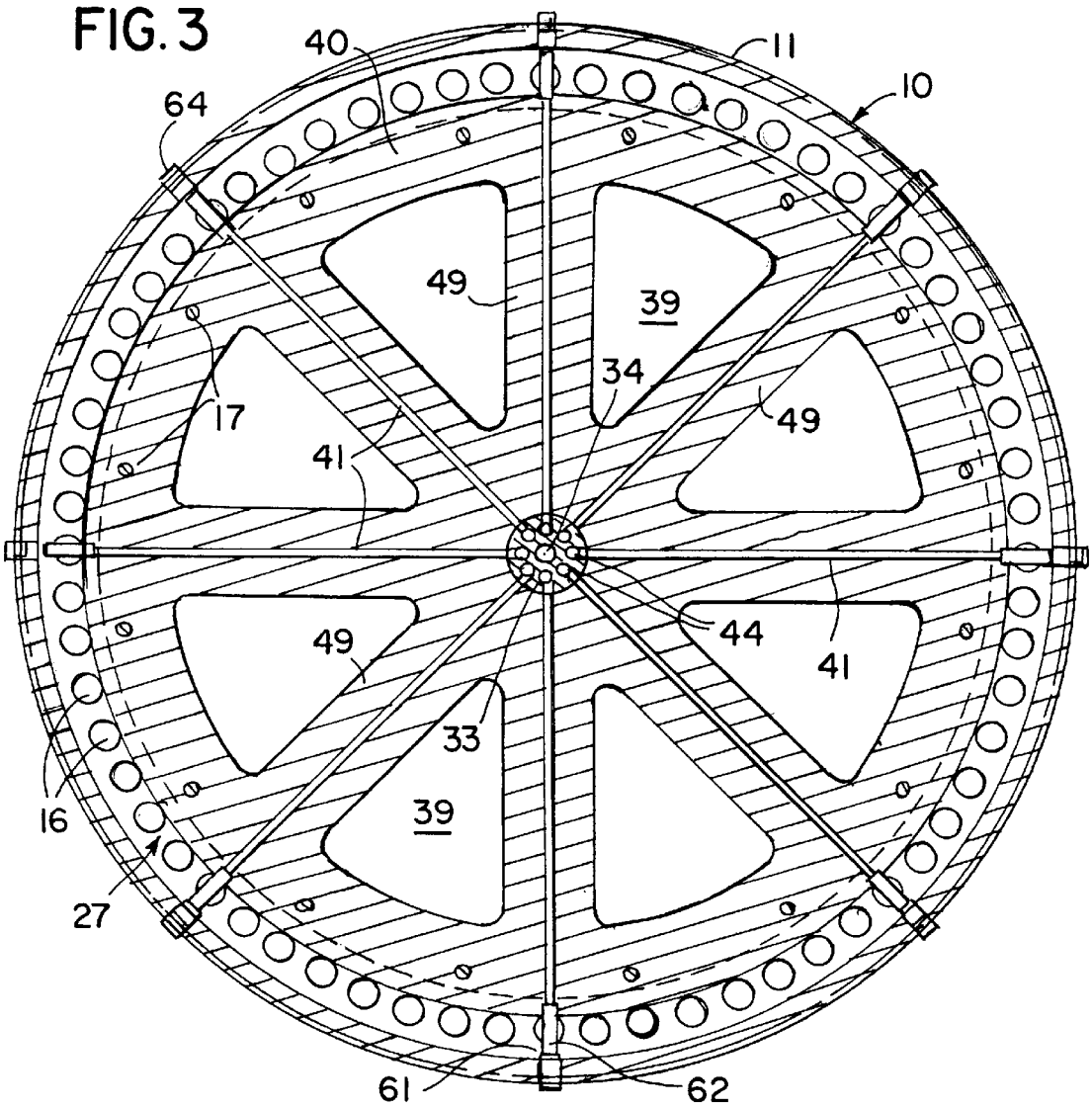
FIG. 3 is a vertical section taken on line 3—3 of FIG. 2.
Figure 4:
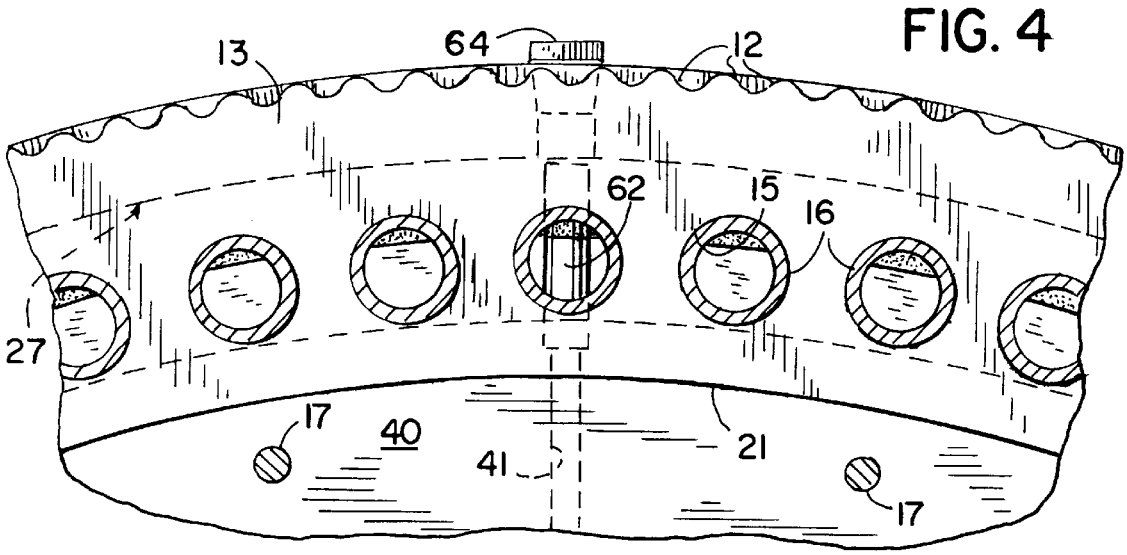
FIG. 4 is a partial vertical section taken on line 4—4 of FIG. 2.
Figure 5:
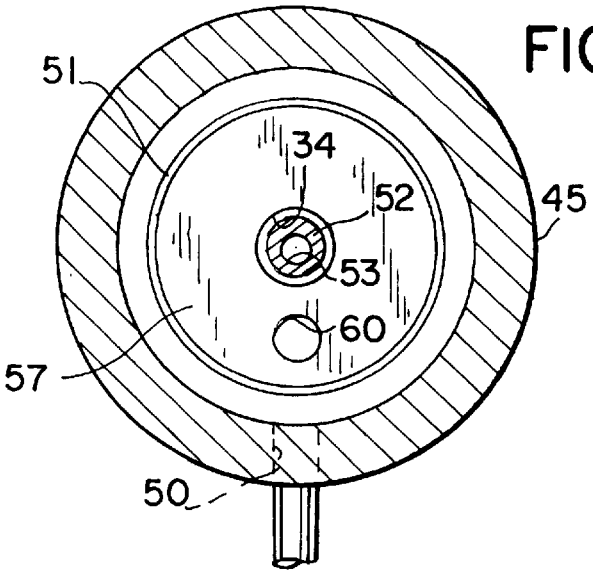
FIG. 5 is a vertical section taken on line 5—5 of FIG. 2.

The presently preferred embodiment of the invention is shown in FIGS. 1–6. The invention is shown as applied to a steam heated corrugating roll 10 of the type used in the manufacture of a single face corrugated paperboard web. Thus, the outer periphery of the cylindrical outer wall 11 of the roll is provided with a pattern of teeth or flutes 12 which, with a similar inter-engaging and counterrotating roll (not shown) form a nip in which a paper web is corrugated prior to being glued to a liner web to form the single face paperboard web, all in a manner well known in the art. It is also known in the art to heat the interior of the roll with steam to enhance the curing of the glue used to join the web components. The heated roll 10 of the present invention is constructed to alleviate the problems in prior art rolls discussed above.

The fluted cylindrical outer wall 11 of the roll may comprise a solid shell with the pattern of flutes 12 formed therein in any convenient manner. In accordance with the first disclosed embodiment, however, the outer wall 11 is formed of a laminate of relatively thin annular ring segments 13. The ring segments 13 may be stamped or formed in any convenient manner to include the pattern of teeth 14, as well as a steam tube hole 15. The laminated wall 11 is held together by a combination of a series of generally parallel and axially extending steam tubes 16 which are captured with a force fit in the aligned steam tube holes 15. A plurality of tie rods 17 may also be used to apply an axial clamping force. The tie rods also function to attach the roll end walls 18 to the outer wall 11.

Each of the two end walls 18 is of a similar construction and made from relatively heavy plate stock which may, for example, have a thickness in the range of about 2½ inches to 3 inches (about 64–76 mm). The end walls are preferably provided with cut-out or open sectors 39 divided by radially extending spokes 49. The inside face of the outer rim of each end wall 18 is provided with an annular shoulder 20 which, after assembly, extends into and fits closely with the inside cylindrical surface 21 of the outer wall 11. The narrow end face 22 of the wall 18 is provided with a pair of concentric annular grooves 23 which seat annular O-ring seals 24. Each of the end walls 18 also includes a large annular groove 25 between and concentric with the O-ring seal grooves 23. When the end walls 18 are attached to the cylindrical outer wall 11, the annular groove 25 is aligned with the open ends of the steam tubes 16. The large groove 25 in one end wall 18 forms a steam supply header 26 and the groove 25 in the other end wall comprises a condensate return header 27. Thus, steam supplied to the steam supply end wall 29 is distributed radially and uniformly to the steam header 26 (in a manner to be described), flows axially through the steam tubes 16, and the condensate flows (under the influence of the small differential between steam supply pressure and condensate return pressure) into the condensate header 27, and is returned radially through the condensate return end wall 40 for collection (also in a manner to be described).

A steam delivery tube 19 extends axially through the roll 10 between opposite stub shafts 30 and 33. The roll end walls 18 are welded or otherwise secured to the respective stub shafts for rotation therewith. One stub shaft 30 attached to the steam supply end wall 29 is closed at one end and is rotatably supported on the machine frame 31 with a roll bearing 32. The other stub shaft 33 on the opposite condensate return end of the roll is axially through-bored and is also supported on the machine frame 31 with a similar roll bearing 32. The steam delivery tube 19 interconnects stub shafts 30 and 33. The steam supply end wall includes a central stub shaft opening 35 through which the stub shaft 30 extends. The end wall 29 is provided with a series of steam transfer bores 36 which are spaced circumferentially around the roll axis and extend radially through the spokes 49 and between the shaft opening 35 and the inner shoulder 37 of the steam header 26. The inner end of each steam transfer bore 36 is aligned with a radial steam port 38 drilled in the stub shaft 30 into the stub shaft bore 34. Steam supplied to the opposite open stub shaft 33 travels along the steam delivery tube 19, into the stub shaft bore 34, through the steam ports 38 in the stub shaft, and radially outwardly along the steam transfer bores 36 in the spokes 49 in end wall 29 into the steam supply header 26.

Steam from the supply header 26 travels along the steam tubes 16 and condensate is collected in the condensate header 27 in the condensate return end wall 40 on the opposite end. In a manner similar to the steam supply end wall 29, the spokes 49 in the condensate return end wall 40 are provided with radially extending condensate transfer bores 41 which are spaced circumferentially around the roll axis. The condensate transfer bores 41 extend from bore openings in the annular inner shoulder 42 of the condensate header 27 to condensate ports 43 in the stub shaft 33. The stub shaft 33 is provided with a plurality of circumferentially spaced axial blind condensate bores 44 to receive the return flow of condensate from each of said condensate transfer bores 41 in the end wall 40. Thus, condensate collecting in the condensate header 27 flows radially inwardly through the condensate transfer bores 41 and condensate ports 43 into the blind bores 44, from which the flow continues axially out of the open end of stub shaft 33, and then to condensate drain 50 for delivery to a trap or to another steam user.

The continuous flow of steam into the roll and concomitant continuous return flow of condensate is shown schematically in FIG. 10 and provides two inherent benefits. The radial steam transfer bores 36 in end wall 29 and the corresponding condensate transfer bores 41 in end wall 40 are intimately heated with the same heating fluid which heats the cylindrical outer wall 11 of the roll. As a result, there is much less chance for the occurrence of thermal distortion between the outer wall and the end walls. In addition, the continuous flow through system helps to keep the steam and condensate paths flushed of non-condensible gases. This allows the full heat capacity of the steam to be utilized.

Figure 9:
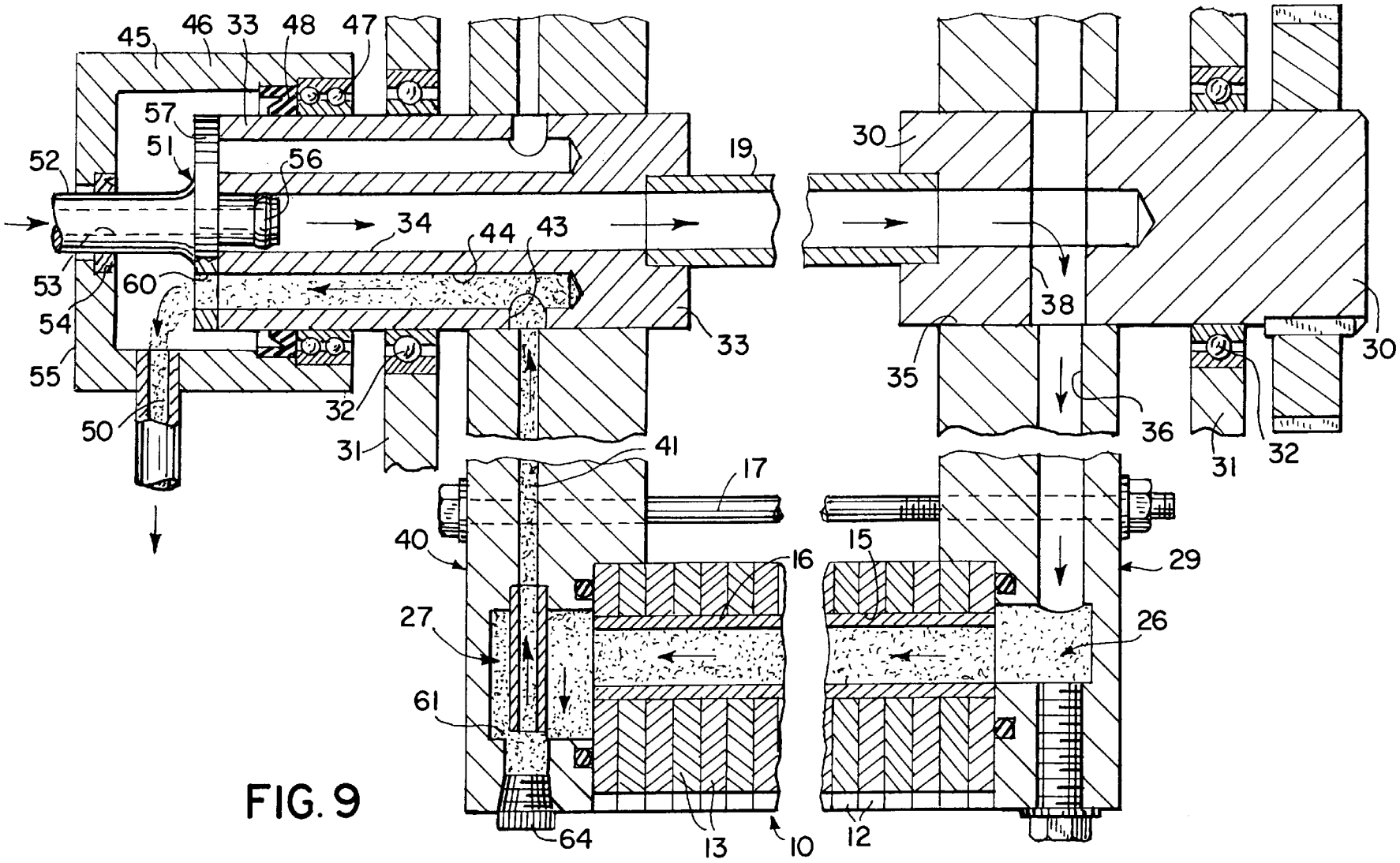
FIG. 9 is a partial vertical section through the lower portion of the heated roll of FIG. 1.

In accordance with another aspect of the subject invention, the roll 10 is provided with a unique condensate return flow valving system which provides effective removal of condensate at low roll speeds or when the roll is stopped. If the roll as thus far described is slowed or stopped, condensate which had been held by centrifugal force against the radially outermost surfaces in the condensate path will tend to flow downwardly by gravity and pool in the lowermost portions of the condensate paths, as shown in FIG. 9. Under these conditions and without the unique condensate control valve to be described, steam pressure may be inadequate to overcome the static head necessary to lift the condensate from the lowermost regions because steam and condensate flow will tend to follow the lower pressure paths in the upper regions of the steam/condensate flow path. As a result, pooled condensate in the lower region of the roll will tend to accumulate and insulate the outer wall 11 from the conduction of heat because water has poor heat conductivity as compared to steel. The remainder of the cylindrical outer wall of the roll remains preferentially heated to operating temperature. The insulated lower portion may bow inwardly as a result of thermal contraction. Upon re-start, the distortion may be so severe as to cut or tear the paperboard web being processed.

Figure 6:
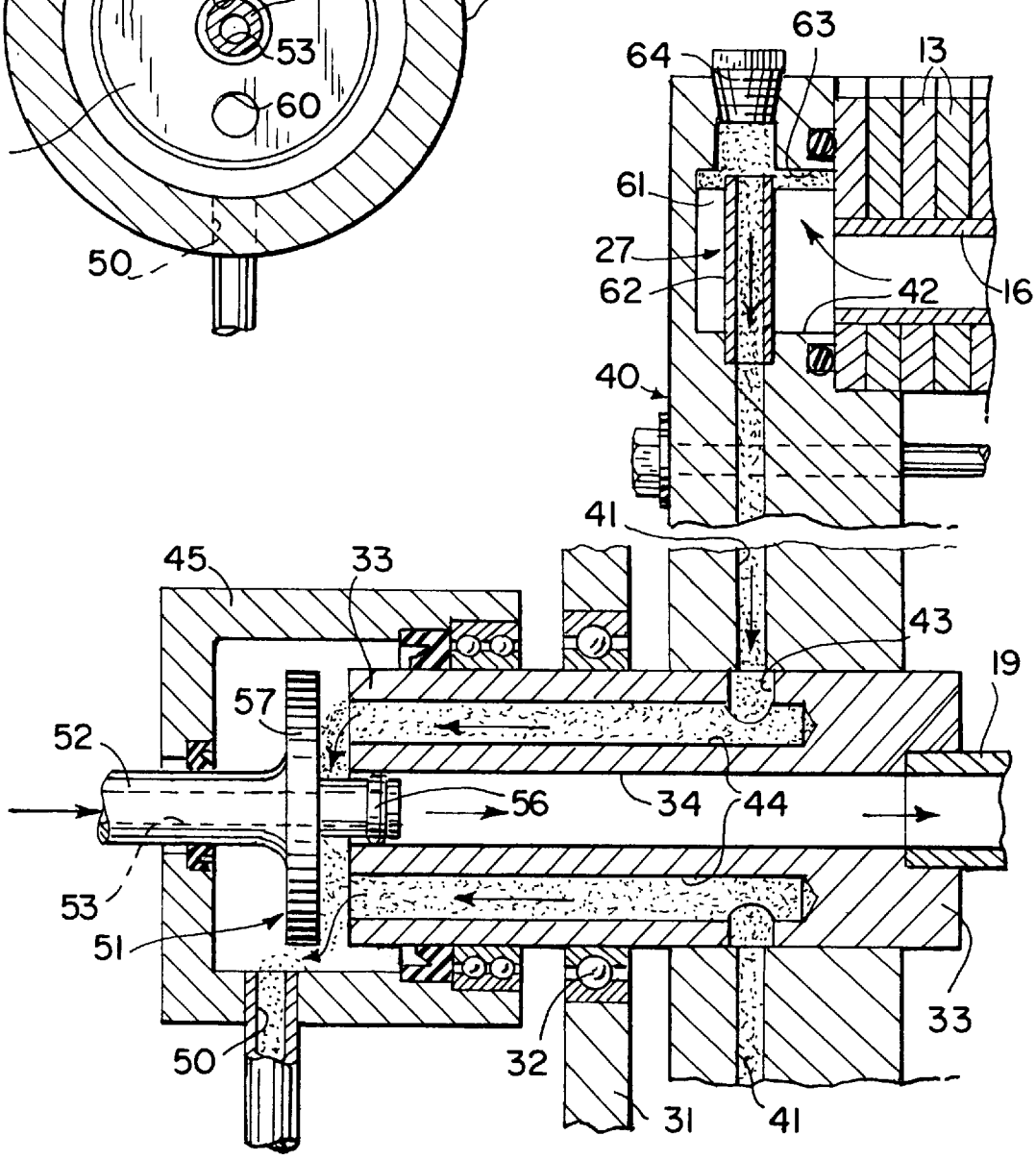
FIG. 6 is a sectional view showing a portion of FIG. 2 with the condensate control valve shown in its other operative position.

The open end of the stub shaft 33 is surrounded by an enclosing end cap 45. The end cap is stationary with respect to shaft rotation and includes a cylindrical outer sleeve 46 which is separated from the roll shaft with a bearing 47 and rotary seal 48. The bottom of the sleeve 46 is provided with a condensate drain hole 50 from which condensate leaving the axial condensate bores 44 in the shaft 28 is returned to the steam boiler system. A condensate control valve 51 includes a tubular body 52 having a through steam supply bore 53. One end of the tubular body 52 is supported in the outer wall 55 of the end cap 45 by an annular seal 54. The opposite inner end of the tubular body 52 is supported for sliding movement within the steam bore 34 with an inner annular seal 56. The valve 51 includes an integral valve plate 57 which overlies the open end of shaft 33 and is movable axially with the tubular body 52 to selectively close most of the condensate return bores 44 (FIGS. 2 and 9) or to open all of said bores (FIG. 6). In the closed or righthandmost position of the valve plate 57 (FIGS. 2 and 9), the inner plate face 58 abuts the flat end of the shaft to seal all of the blind bores 44, except the lowermost of said bores which is aligned with a valve plate aperture 60 in the lowermost or 6 o'clock position of the valve plate 57. The condensate end wall 40 may conveniently be provided with eight circumferentially spaced radial condensate transfer bores 41 and, correspondingly, the roll shaft 28 will be provided with eight axial blind condensate bores 44, seven of which are sealed by the valve plate 57 in the abutting sealed position. The valve is controlled by conventional operator means, such as an air cylinder to move between the open and closed positions, based on the rotational speed of the drum. A suitable mechanical or electrical detent mechanism (not shown) may be utilized to assure that one blind axial bore 44 is directly aligned with the valve plate aperture 60 whenever roll rotation ceases. The flow of steam continues into the stub shaft steam bore 34 through the supply bore 53 in both axial positions of the valve 51.

As the roll comes to a stop, the portion of the condensate return header 27, which is radially beyond the outermost portion of the steam tubes 16, defines a sump 61 which, in the 6 o'clock position, is the lowest point in the condensate return path and the point to which all condensate draining by gravity will tend to flow. With all but the lowermost of the condensate return paths closed by the valve plate 57, the condensate pooling in the sump 61 will preferentially be returned under the influence of the differential in steam supply pressure and condensate return pressure via the vertically oriented condensate transfer bore 41 in the 6 o'clock position (FIG. 9), its corresponding blind axial condensate bore 44 and the valve plate aperture 60. To assure that as much condensate as practical is extracted from the sump 61, each of the condensate transfer bores 41 includes a radially extending standoff 62 which extends from the annular inner shoulder 42 of the header 27 to a point closely spaced from the annular outer shoulder 63 (which forms the lowermost surface of the sump 61). To facilitate boring of the radial transfer bores 41, tapping the outer ends thereof, and insertion of the threaded standoff 62, the annular outer surface of the end wall 40 is bored through to the header groove 25 and subsequently tapped and closed with a threaded plug 64.

Referring now to FIGS. 7 and 8, there is shown another embodiment of a heated roll which utilizes an outer wall 65 of a substantially different construction. The basic function of the flow through steam and condensate system of the preferred embodiment remains unchanged including the construction of the end walls 29 and 40, the shaft 28, and the condensate control valve 51. The steam tubes 66 of this embodiment are of a generally rectangular cross section and may be formed from circular section tube stock by forming over a rectangular mandrel. The steam tubes 66 are spaced circumferentially around a series of circular ribs 67. The ribs 67 extend between axial end ribs which rest on the respective annular shoulders 20 of the end walls and are sealed to the end wall faces with O-ring seals 24, in a manner similar to the previously described embodiment.

Circumferential spacing between the steam tubes 66 on the ribs 67 is maintained by inserting tapered wedge bars 68 between adjacent tube side walls and welding the same to the ribs 67. The OD of the composite assembly of steam tubes 66 and wedge bars 68 is then turned, ground or otherwise finished to a true cylindrical shape. Fluted sleeves 70 having the appropriate corrugated tooth profile are then shrink fit over the finished OD to complete the construction of the outer wall 65. The assembly is held together with a series of machine screws 69 extending through the end walls and tapped into the endmost sleeves 70.

Each steam tube 66 has an extruded copper bar 71 inserted therein and extending the full axial length thereof. The radial inner surface of each bar 71 has a ribbed or fluted construction to form, in cross section, a series of peaks and valleys in each tube. In a manner known in the art, the valleys assist in the axial movement of condensate toward the condensate header 27 and the peaks extend beyond the depth of the normal condensate layer in the tubes to assure good thermal conductivity to the outer corrugating sleeves 70. Conductivity is further enhanced by utilizing copper metal in the bars 71 which has a much higher heat conductivity than steel. The bars are held in place and in intimate contact with the inside surface of the steam tubes by wave springs 72.

In an alternate mode of operation for the condensate control valve 51, the tubular body 52 and integral valve plate 57 may be rotated slightly on the valve axis and in the direction of roll rotation to permit the valve plate aperture 60 to follow the maximum depth of condensate in the return header 27 until rimming occurs at higher rotational speeds. Valve body rotation may be effected with a suitable operator, such as a pneumatic actuator responsive to rotational speed of the roll. As roll rotation increases from a stop position, there is a tendency for water in the sump 61 to be picked up and moved rotationally upwardly from the lowermost 6 o'clock position. In order to assure that maximum condensate pick-up is effected, rotational repositioning of the aperture 60 while maintaining the valve plate closed (FIGS. 2 and 9) will help assure maximum condensate return flow. When rimming of the condensate occurs (when the centrifugal force exceeds the force of gravity), the valve 51 is moved axially away from the open shaft end 33 (FIG. 6), thereby opening all of the remaining axial condensate bores 44 to the flow of condensate and the return of the system to full flow-through operation.

The process of controlling the rotational position of valve plate 57 to maximize condensate pick-up and return flow is shown schematically in the several views of FIGS. 11A through 11D. View 11A shows the drum in the stopped position with the condensate C pooling at the bottom of the sump 61 in the condensate return header 27. The valve plate is positioned with the aperture 60 in the lowermost or 6 o'clock position where it is aligned with the condensate transfer path leading directly from the lowermost position of the sump 61. As rotation of the drum is commenced, the water in the sump will be picked up and moved upwardly in the direction of rotation, as shown in schematic FIG. 11B. The center of mass of the condensate C in the sump will also move and the condensate control valve 51 is indexed rotationally to align the valve plate aperture 60 with the condensate return path closest to the center of mass of the condensate in the sump. Increasing rotational speed of the roll will cause the mass of condensate C in the sump to continue to move in a counterclockwise direction and to thin somewhat as shown in FIG. 11C. The valve plate 57 is rotationally indexed accordingly. At normal operating speed, rimming of the condensate C occurs and it is spread uniformly around the periphery of the sump 61, as shown in FIG. 11D. At this point, the control valve 51 is moved axially away from the stub shaft end, thereby opening all condensate transfer bores 41 to provide uniform condensate return. The valve plate 57 may provided with more than one aperture 60 such that condensate return may be effected through two or more condensate transfer bores 41 and related portions of the return flow paths while the remaining condensate transfer bores are held closed.

I claim:

1. A steam heated roll rotatable on a generally horizontal axis and having a cylindrical outer wall, a pair of enclosing end walls, a series of generally parallel and axially extending open-ended steam tubes mounted in heat conducting contact with the cylindrical outer wall, an annular steam header interconnecting the open ends of the tubes on one end of the roll, and an annular condensate header interconnecting the open ends of the tubes on the other end of the roll, the improvement comprising:

a steam inlet in one end wall;

a plurality of radially extending steam transfer passages spaced circumferentially around the roll axis adjacent one end wall and providing steam transfer paths between said steam inlet and the steam header;

a condensate outlet in one end wall;

a plurality of radially extending condensate transfer passages spaced circumferentially around the roll axis adjacent the other end wall and providing condensate transfer paths between the condensate header and said condensate outlet; and, a valve in said condensate outlet adapted to block the flow of condensate through selected condensate transfer passages in a first valve position and to permit the flow of condensate through all of said condensate transfer passages in a second valve position.

2. The apparatus as set forth in claim 1 wherein said steam transfer passages and said condensate transfer passages comprise radial bores in said respective end walls.

3. The apparatus as set forth in claim 2 wherein each of said annular headers is formed in the radial outer edge of its respective end wall.

4. The apparatus as set forth in claim 3 wherein said condensate header includes an integral annular sump positioned to form a radially outermost sump surface which sump surface defines a lowermost condensate collection point for at least one condensate transfer passage in said first valve position.

5. The apparatus as set forth in claim 1 including a roll shaft ends attached to the end walls and mounting the roll for rotation.

6. The apparatus as set forth in claim 5 wherein said steam inlet and said condensate outlet are each formed in a shaft end.

7. The apparatus as set forth in claim 5 wherein said steam inlet and said condensate outlet are formed in the same a shaft end and including a steam delivery conduit extending axially through the roll interior between the shaft ends.

8. The apparatus as set forth in claim 7 wherein said condensate outlet comprises a plurality of circumferentially spaced axial blind bores in said shaft end, each of said blind bores having open communication with a radial condensate transfer passage.

9. The apparatus as set forth in claim 8 wherein said steam inlet comprises an axial bore in said shaft concentric with said plurality of blind bores.

10. The apparatus as set forth in claim 9 wherein said valve means comprises a steam inlet sleeve slidable axially in said axial shaft bore and providing a steam path in both the first and second valve positions.

11. A fluid heated roll rotatable on a generally horizontal axis and having a cylindrical outer wall, a pair of enclosing end walls, a series of generally parallel and axially extending open-ended heating fluid tubes disposed circumferentially around and in heat conducting contact with the cylindrical outer wall, an annular heating fluid supply header interconnecting the open ends of the tubes on one end of the roll, an annular heating fluid return header interconnecting the open ends of the tubes on the other end of the roll, and roll shaft ends extending axially into the roll interior, said shaft ends attached to the end walls and supporting the roll for rotation, the roll further comprising:

a heating fluid conduit extending axially between the shaft ends from an open shaft end adjacent one end wall to a closed end adjacent the other end wall;

a plurality of radially extending heating fluid supply passages formed in said other end wall, said passages spaced circumferentially around the shaft end and providing fluid transfer paths between said fluid inlet and the fluid supply header;

a fluid return outlet in said open shaft end adjacent said one end wall;

a plurality of radially extending fluid return passages formed in said one end wall, said passages spaced circumferentially around the shaft and providing fluid return paths between the fluid return header and said fluid return outlet; and, a condensate control valve operatively connected to said fluid return outlet to block the return flow of heating fluid through selected of said fluid return passages in a first valve position and to permit the flow of heating fluid through all of said return passages in a second valve position.

12. The apparatus as set forth in claim 11 wherein said fluid return outlet comprises a plurality of circumferentially spaced axial blind bores, each of said bores connecting to the radial inner end of one of said fluid return passages.

13. The apparatus as set forth in claim 12 wherein said control valve comprises:

a valve body including a fluid inlet sleeve slidably received in said open shaft end of said fluid inlet; and, a radial flange on said valve body overlying the opening in said one shaft end, said flange operable to block all but the lowermost of said axial blind bores in the first valve position and to open all of said axial blind bores in the second valve position.

14. The apparatus as set forth in claim 13 including an operator for rotating said valve body on its axis and in the direction of roll rotation in response to rotational speed of the roll.

15. The apparatus as set forth in claim 13 including a detent for positioning said lowermost axial blind bore in the lowermost position of rotational movement when roll rotation is stopped.

* * * * *